US012276222B2

(12) United States Patent
Finidori et al.

(10) Patent No.: US 12,276,222 B2
(45) Date of Patent: Apr. 15, 2025

(54) CONTROLLABLE MECHANICAL MOTOR VEHICLE COOLANT PUMP

(71) Applicant: PIERBURG PUMP TECHNOLOGY GMBH, Neuss (DE)

(72) Inventors: Laurent Finidori, Bertrange (FR); Jerome Kremer, Inglange (FR); Gilles Simon, Montois la Montagne (FR); Gilles Rybicki, Metz (FR)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 0 days.

(21) Appl. No.: 18/561,295

(22) PCT Filed: May 20, 2021

(86) PCT No.: PCT/EP2021/063544
§ 371 (c)(1),
(2) Date: Nov. 16, 2023

(87) PCT Pub. No.: WO2022/242866
PCT Pub. Date: Nov. 24, 2022

(65) Prior Publication Data

US 2024/0247606 A1 Jul. 25, 2024

(51) Int. Cl.
*F01P 5/10* (2006.01)
*F04D 13/02* (2006.01)
(Continued)

(52) U.S. Cl.
CPC ..... *F01P 5/10* (2013.01); *F04D 13/02* (2013.01); *F04D 15/0038* (2013.01); *F04D 29/426* (2013.01)

(58) Field of Classification Search
CPC ..... F04D 15/0038
See application file for complete search history.

(56) References Cited

U.S. PATENT DOCUMENTS 3,784,318 A * 1/1974 Davis ..... F04D 29/468 415/164
4,802,817 A * 2/1989 Tyler ..... F04D 29/468 415/49
(Continued)

FOREIGN PATENT DOCUMENTS

DE 10 2008 059 462 A1 6/2009
DE 102013111939 B3 * 10/2014 ..... F04D 13/12
(Continued)

*Primary Examiner* — Laert Dounis
(74) *Attorney, Agent, or Firm* — Norman B. Thot

(57) ABSTRACT

A controllable mechanical motor vehicle coolant pump includes a rotatable drive shaft co-rotatably connected with a coolant pump wheel, a transverse housing surface extending transversely with respect to and surrounding the drive shaft, a cylindrical inner slider support surface radially surrounding the drive shaft, a control slider which is axially shiftable with respect to the coolant pump wheel so as to control an effective discharge flow cross-section thereof, and a push-out pressure chamber. The push-out pressure chamber is arranged between a slider bottom wall of the control slider and the transverse housing surface, is defined at one axial side by the transverse housing surface and radially inwardly by the cylindrical inner slider support surface, and is pressurized to generate a push-out push force which pushes the slider bottom wall toward the coolant pump wheel. A first housing element defines the transverse housing surface and the inner slider support surface.

14 Claims, 1 Drawing Sheet

(51) Int. Cl.
*F04D 15/00* (2006.01)
*F04D 29/42* (2006.01)

(56) References Cited

U.S. PATENT DOCUMENTS

| | | | | |
|---|---|---|---|---|
| 2018/0313251 | A1 | 11/2018 | Zielberg et al. | |
| 2018/0320693 | A1 | 11/2018 | Zielberg et al. | |
| 2018/0320695 | A1 * | 11/2018 | Zielberg | F04D 15/0038 |

FOREIGN PATENT DOCUMENTS

| | | | | |
|---|---|---|---|---|
| EP | 3 431 768 | A1 | | 1/2019 |
| GB | 144709 | A | * | 8/1921 |
| WO | WO 2017/076648 | A1 | | 5/2017 |
| WO | WO 2017/076649 | A1 | | 5/2017 |

* cited by examiner

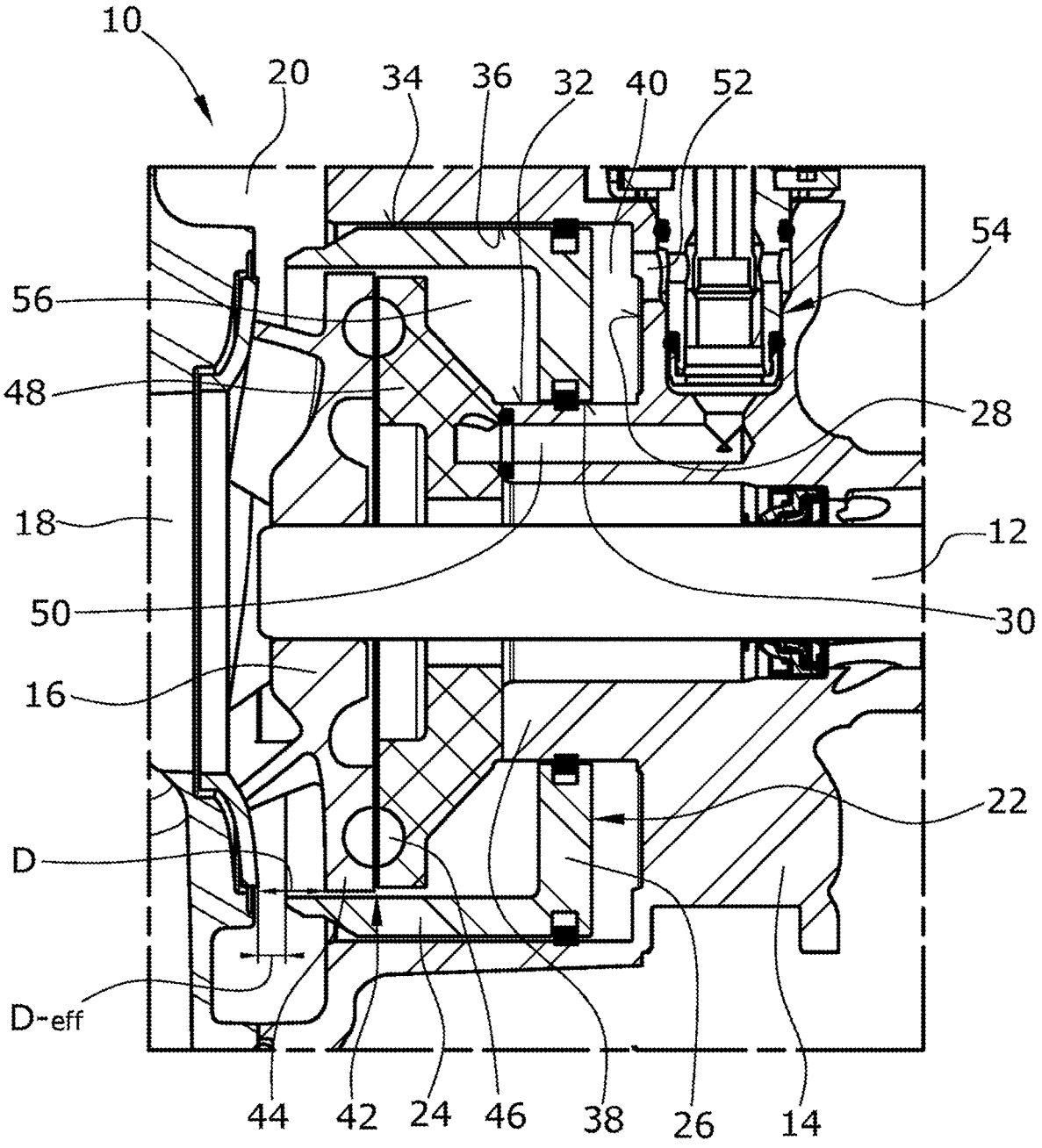
10
20
34
36
32
40
52
54
56
48
28
18
12
50
30
16
22
D
D-eff
44
42
24
46
38
26
14

CONTROLLABLE MECHANICAL MOTOR VEHICLE COOLANT PUMP

CROSS REFERENCE TO PRIOR APPLICATIONS

This application is a U.S. National Phase application under 35 U.S.C. § 371 of International Application No. PCT/EP2021/063544, filed on May 20, 2021. The International Application was published in English on Nov. 24, 2022 as WO 2022/242866 A1 under PCT Article 21(2).

FIELD

The present invention is directed to a controllable mechanical motor vehicle coolant pump, in particular to a controllable mechanical motor vehicle coolant pump which is configured to pump a liquid coolant through a cooling circuit of an internal combustion engine of a motor vehicle at a relatively high flow rate.

FIELD

Mechanical motor vehicle coolant pumps are mechanically driven by a crank shaft of the internal combustion engine, for example, via a belt drive, a chain drive or a gearing. The rotational speed of a coolant pump wheel of mechanical motor vehicle coolant pumps is therefore always proportional to the rotational speed of the crank shaft of the internal combustion engine. The cooling demand of the internal combustion engine is, however, typically not proportional to the rotational speed of the crank shaft. Controllable mechanical motor vehicle coolant pumps are therefore provided with an arrangement which allows the coolant discharge flow to be controlled without controlling the rotational speed of the coolant pump wheel. One concept to realize the control of the discharge flow is to provide a control slider which is configured to be axially shiftable with respect to the coolant pump wheel in order to control an effective discharge flow cross-section of the coolant pump wheel by partially or completely covering the radial outside of the coolant pump wheel with a cylindrical side wall of the control slider.

Such a controllable mechanical motor vehicle coolant pump is described in WO 2017/076649 A1. The coolant pump there described comprises a push-out pressure chamber which is configured to be hydraulically pressurized in order to generate a hydraulic push-out push force which axially pushes the control slider in the axial pump direction over the coolant pump wheel. The push-out pressure chamber is defined axially by a slider bottom wall of the control slider as well as by a transverse housing surface, and is defined radially inwardly by an inner slider support surface which shiftably supports a radially inner bottom wall surface of the slider bottom wall.

The transverse housing surface is defined by a first housing element, and the inner slider support surface is defined by a separate second housing element which axially abuts the transverse housing surface of the first housing element. The unsealed contact interface between the second housing element and the transverse housing surface allows a pressurized liquid to leak into the push-out pressure chamber from a fluid channel located radially inward of the inner slider support surface within the second housing element. This leakage can lead to an unintentional increase of the hydraulic pressure of the push-out pressure chamber, which can in turn cause an unintentional shifting of the control slider toward the coolant pump wheel, and thus an unintentional reduction of the effective discharge flow cross section of the coolant pump wheel by the control slider. Insufficient discharge flow of the coolant pump can, however, cause severe damage to the internal combustion engine of a motor vehicle.

SUMMARY

An aspect of the present invention is to provide a controllable mechanical motor vehicle coolant pump which allows for a reliable control of the coolant discharge flow.

In an embodiment, the present invention provides a controllable mechanical motor vehicle coolant pump which includes a drive shaft which extends in an axial pump direction and which is configured to rotate and to be mechanically driven by an engine of a motor vehicle, a coolant pump wheel which is co-rotatably connected with the drive shaft and which is configured to pump a liquid coolant, a transverse housing surface which extends substantially transversely with respect to the drive shaft and which radially surrounds the drive shaft, a cylindrical inner slider support surface which radially surrounds the drive shaft and which is coaxial to the drive shaft, a control slider which is configured to be axially shiftable with respect to the coolant pump wheel so as to control an effective discharge flow cross-section of the coolant pump wheel, and a push-out pressure chamber. The control slider comprises a substantially cylindrical slider side wall which is configured to radially surround the coolant pump wheel, and a slider bottom wall which extends substantially transversely with respect to the drive shaft and which is arranged axially between the coolant pump wheel and the transverse housing surface. The slider bottom wall comprises a radially inner bottom wall surface which is shiftably supported by the cylindrical inner slider support surface. The push-out pressure chamber is arranged between the slider bottom wall and the transverse housing surface, is defined at one axial side by the transverse housing surface and radially inwardly by the cylindrical inner slider support surface, and is configured to be hydraulically pressurized so as to generate a hydraulic push-out push force which pushes the slider bottom wall toward the coolant pump wheel. The transverse housing surface and the inner slider support surface are both defined by a first housing element.

BRIEF DESCRIPTION OF THE DRAWING

The present invention is described in greater detail below on the basis of embodiments and of the drawing in which:

The FIGURE shows a sectional view of a controllable mechanical motor vehicle coolant pump according to the present invention which is configured to pump a liquid coolant through a cooling circuit of an internal combustion engine of a motor vehicle.

DETAILED DESCRIPTION

The controllable mechanical motor vehicle coolant pump according to the present invention is a flow pump, for example, a centrifugal pump, which is configured to pump a liquid coolant, such as water, from a pump inlet to a pump outlet. The controllable mechanical motor vehicle coolant pump according to the present invention can, for example, be configured to pump a liquid coolant through a cooling circuit of an internal combustion engine.

The controllable mechanical motor vehicle coolant pump according to the present invention is provided with a rotatable drive shaft which extends in an axial pump direction. The drive shaft is configured to be mechanically driven by an engine of a motor vehicle, for example, via a gearing, a belt drive or a chain drive.

The controllable mechanical motor vehicle coolant pump according to the present invention is also provided with a coolant pump wheel which is co-rotatably connected with the drive shaft and which is configured to pump the liquid coolant from the pump inlet to the pump outlet. The coolant pump wheel can, for example, be arranged at an axial end of the drive shaft, and the pump inlet can, for example, be arranged coaxial to the coolant pump wheel so that the liquid coolant flows axially against a central part of the coolant pump wheel. The pump outlet can, for example, be arranged radially outward of the coolant pump wheel so that the liquid lubricant is accelerated toward the pump outlet by the centrifugal force generated by the rotating coolant pump wheel.

The controllable mechanical motor vehicle coolant pump according to the present invention is also provided with a transverse housing surface which extends substantially transversely with respect to the drive shaft and which radially surrounds the drive shaft. The transverse housing surface can, for example, be substantially perpendicular to the drive shaft. The transverse housing surface need not be completely flat, but can also have axially protruding and/or axially recessed surface sections.

The controllable mechanical motor vehicle coolant pump according to the present invention is also provided with a cylindrical inner slider support surface which radially surrounds the drive shaft and is coaxial to the drive shaft. The cylindrical inner slider support surface is typically circular cylindrical, i.e., provided with a circular radial cross section, but can generally be provided with any radial cross-sectional shape, e.g., elliptical or polygonal.

The controllable mechanical motor vehicle coolant pump according to the present invention is also provided with a substantially pot-shaped control slider which is arranged coaxially with respect to the drive shaft and the coolant pump wheel, and which radially surrounds the drive shaft. The control slider can, for example, be designed as a single piece. The control slider comprises a substantially cylindrical slider side wall which is configured to radially surround the coolant pump wheel, i.e., the slider side wall is provided with an inner diameter which is slightly larger than the outer diameter of the coolant pump wheel. The slider side wall is typically circular-cylindrical. The control slider also comprises a slider bottom wall which extends substantially transversely with respect to the drive shaft and is arranged axially between the coolant pump wheel and the transverse housing surface. A radially inner bottom wall surface of the slider bottom wall is shiftably supported by the inner slider support surface in all possible shifting positions of the control slider.

The control slider is configured to be axially shiftable with respect to the coolant pump wheel between a maximum-discharge-flow position and a minimum-discharge-flow position in order to control an effective discharge cross section, and thus a discharge flow out, of the coolant pump wheel by partially or completely covering the radially outward discharge flow cross section of the coolant pump wheel with the cylindrical slider side wall. The control slider can, for example, be configured to completely cover the discharge cross section of the coolant pump wheel if positioned in the minimum discharge-flow position, and to completely uncover the discharge cross section of the coolant pump wheel if positioned in the maximum-discharge-flow position. The effective discharge cross section of the coolant pump wheel, i.e., the part of the discharge cross section which is not covered by the slider side wall of the control slider, is in any case smaller if the control slider is positioned in the minimum discharge-flow position than if the control slider is positioned in the maximum-discharge-flow position.

The controllable mechanical motor vehicle coolant pump according to the present invention is also provided with a push-out pressure chamber which is located between the slider bottom wall and the transverse housing surface. The push-out pressure chamber is defined at one axial side by the transverse housing wall and radially inwardly by the inner slider support surface. The push-out pressure chamber is configured to be hydraulically pressurized in order to generate a hydraulic push-out push force which pushes the slider bottom wall away from the transverse housing surface and toward the coolant pump wheel, and thus pushes the control slider toward the minimum-discharge-flow position. The push-out pressure chamber is typically annular and radially surrounds the drive shaft. The push-out pressure chamber can, for example, be configured to be hydraulically pressurized by being filled with pressurized coolant.

The present invention provides that the transverse housing surface and the inner slider support surface are both defined by a first housing element. There is therefore no contact interface between separate housing elements at the radially inner side of the push-out pressure chamber via which liquid could leak into the push-out pressure chamber. This avoids an unintentional pressurization of the push-out pressure chamber and therefore provides a reliable control of the control slider position and thus of the discharge flow of the coolant pump. The inner slider support surface is in particular defined by a cylindrical protrusion of the first housing element which axially protrudes from the transverse housing surface. The transverse housing surface and the inner slider support surface can, for example, both be defined by a main housing body which supports the drive shaft.

In an embodiment of the present invention, the first housing element can, for example, also define a cylindrical outer slider support surface which shiftably supports a radially outer side wall surface of the cylindrical slider side wall so that the control slider is supported on its radial inside and on its radial outside by the same housing element. This allows the radial distance between the inner slider support surface and the outer slider support surface to be defined very accurately because manufacturing tolerances only need to be considered for a single housing element. The accurate manufacturing of the slider support surfaces provides for a reliable sealing of the radial gap between the control slider and the surrounding housing element via a sealing ring, which avoids or at least minimizes a liquid leakage out of the push-out control chamber. The accurate manufacturing of the control slider chamber also provides for a reliable and smooth shiftable support of the control slider within the surrounding housing element. This provides for a reliable control of the control slider position and therefore of the discharge flow of the coolant pump.

The controllable mechanical motor vehicle coolant pump can, for example, be provided with an auxiliary pumping unit which is configured to hydraulically pressurize the push-out pressure chamber. The auxiliary pumping unit according to the present invention is a so-called side channel pump and comprises an auxiliary pumping unit side channel and an auxiliary pumping unit pump wheel. The auxiliary pumping unit side channel is defined by a separate second housing element which is arranged between the coolant pump wheel and the transverse housing surface of the first housing element. The auxiliary pumping unit pump wheel is provided integrally with the coolant pump wheel on a back side of the coolant pump wheel which faces the second housing element. The auxiliary pumping unit allows for a hydraulic actuation of the control slider without requiring an external hydraulic pressure source, wherein the auxiliary pumping unit is very compact and therefore does not require significant additional installation space.

In an embodiment of the present invention, the controllable mechanical motor vehicle coolant pump can, for example, be provided with a push-out pressure chamber feed channel which is configured to fluidically connect the push-out pressure chamber with a discharge side of the auxiliary pumping unit side channel, wherein a section of the push-out pressure chamber feed channel extends between the drive shaft and the inner slider support surface. The push-out pressure chamber feed channel in particular extends axially from the second housing element, which defines the auxiliary pumping unit side channel, into the axially protruding part of the first housing element which defines the inner slider support surface and axially through the complete axial extent of the protruding part to behind the transverse housing surface. A control valve is typically provided within the first housing element for controlling the liquid flow from the push-out pressure chamber feed channel into the push-out pressure chamber. The particular design of the push-out pressure chamber feed channel provides a reliable fluidic connection between the auxiliary pumping unit and the push-out pressure chamber which does not require any complex sealing or significant additional installation space.

The controllable mechanical motor vehicle coolant pump can, for example, be provided with a push-in pressure chamber which is located between the coolant pump wheel and the slider bottom wall, and is configured to be hydraulically pressurized in order to generate a hydraulic push-in push force which pushes the slider bottom wall away from the coolant pump wheel. The push-in pressure chamber can, for example, be permanently pressurized during pump operation. The push-in pressure chamber can, for example, be in fluidic communication with the discharge flow cross section of the (main) coolant pump wheel so that the push-in pressure chamber is permanently filled with pressurized coolant with the pump discharge pressure during pump operation. The present pressure provided by the auxiliary pumping unit must in this case always be higher than the present pressure provided by the coolant pump wheel in order to allow the control slider position to be controlled via controlling the hydraulic pressure of the push-out pressure chamber. The push-in pressure chamber can alternatively be fluidically connected to the discharge side of the auxiliary pumping unit pump wheel, wherein a ratio between the hydraulic pressures of the push-in pressure chamber and of the push-out pressure chamber and thereby the control slider position is controlled by at least one control valve. It is also possible that the auxiliary pumping unit is configured to provide two different hydraulic pressure levels, wherein the push-in pressure chamber is permanently fluidically connected to a lower hydraulic pressure level of the auxiliary pumping unit and the push-out pressure chamber is selectively fluidically connectable to a higher hydraulic pressure level of the auxiliary pumping unit in order to control the hydraulic pressure of the push-out pressure chamber. The push-in pressure chamber allows the control slider to be moved completely hydraulically without requiring any mechanical actuation, such as a preload spring or the like.

An embodiment of the present invention is described below with reference to the enclosed drawing which shows a sectional view of a controllable mechanical motor vehicle coolant pump according to the present invention.

The drawing shows a controllable mechanical motor vehicle coolant pump 10 which is configured to pump a liquid coolant through a cooling circuit of an internal combustion engine of a motor vehicle. The controllable mechanical motor vehicle coolant pump 10 comprises a drive shaft 12 which is rotatably supported within and by first housing element 14 and which extends in an axial pump direction. The drive shaft 12 is configured to be mechanically driven by the internal combustion engine of the motor vehicle. The drive shaft 12 can, for example, be co-rotatably connected with a drive wheel which is driven by a crank shaft of the internal combustion engine via a belt drive.

The controllable mechanical motor vehicle coolant pump 10 comprises a coolant pump wheel 16 which is attached to an axial end of the drive shaft 12 so that the coolant pump wheel 16 rotates together with the drive shaft 12. The coolant pump wheel 16 is configured to pump the liquid coolant from a suction chamber 18, which is axially adjacent to the coolant pump wheel 16 and fluidically connected with a pump inlet, into a discharge chamber 20, which radially surrounds the coolant pump wheel 16 and is fluidically connected with a pump outlet.

The controllable mechanical motor vehicle coolant pump 10 comprises a substantially pot-shaped control slider 22 with a substantially circular-cylindrical slider side wall 24 and a slider bottom wall 26. The slider side wall 24 is provided with an inner diameter which is slightly larger than an outer diameter of the coolant pump wheel 16 so that the slider side wall 24 can radially surround the coolant pump wheel 16. The slider bottom wall 26 extends substantially transversely with respect to the drive shaft 12 and is located axially between the coolant pump wheel 16 and a transverse housing surface 28 of the first housing element 14, which transverse housing surface 28 extends substantially transversely with respect to the drive shaft 12 and radially surrounds the drive shaft 12.

The control slider 22 is shiftably supported within and by the first housing element 14, wherein a radially inner bottom wall surface 30 of the slider bottom wall 26 is supported by a circular-cylindrical inner slider support surface 32 of the first housing element 14, and a radially outer side wall surface 34 of the slider side wall 24 is supported by a circular-cylindrical outer slider support surface 36 of the first housing element 14. The inner slider support surface 32 and the outer slider support surface 36 each radially surround the drive shaft 12 and are each coaxial to the drive shaft 12. The inner slider support surface 32 is defined by a cylindrical protrusion 38 of the first housing element 14, which cylindrical protrusion 38 axially protrudes from the transverse housing surface 28 toward the coolant pump wheel 16. The control slider 22 can be axially shifted with respect to the coolant pump wheel 16, thereby partially or completely covering a radially outward discharge flow cross section D of the coolant pump wheel 16 with the slider side wall 24, as is visible in the drawing, in order to control an effective discharge flow cross section D-eff of the coolant pump wheel 16 which is the uncovered part of the discharge flow cross section D.

The controllable mechanical motor vehicle coolant pump 10 comprises a push-out pressure chamber 40 which is defined axially by the slider bottom wall 26 as well as by the transverse housing surface 28, and which is defined radially by the inner slider support surface 32 and by the outer slider support surface 36. The push-out pressure chamber 40 generates a hydraulic push-out push force which pushes the slider bottom wall 26 away from the transverse housing surface 28 and toward the coolant pump wheel 16 if the push-out pressure chamber 40 is hydraulically pressurized.

The controllable mechanical motor vehicle coolant pump 10 comprises an auxiliary pumping unit 42 with an auxiliary pumping unit pump wheel 44 and an auxiliary pumping unit side channel 46. The auxiliary pumping unit side channel 46 is defined by a separate second housing element 48 which is arranged axially between the coolant pump wheel 16 and the transverse housing surface 28, and which axially abuts the cylindrical protrusion 38 of the first housing element 14. The auxiliary pumping unit pump wheel 44 is provided integrally with the coolant pump wheel 16 and is defined on a back side of the coolant pump wheel 16 which faces the second housing element 48. The auxiliary pumping unit 42 is configured to hydraulically pressurize the push-out pressure chamber 40 via a push-out pressure chamber feed channel 50.

The push-out pressure chamber feed channel 50 is defined by the second housing element 48 and by the first housing element 14. The push-out pressure chamber feed channel 50 extends through the cylindrical protrusion 38 of the first housing element 14 so that a section of the push out pressure chamber feed channel 50 extends between the drive shaft 12 and the inner slider support surface 32. The push-out pressure chamber feed channel 50 extends through the complete cylindrical protrusion 38 to behind the transverse housing surface 28. The push-out pressure chamber feed channel 50 fluidically connects a discharge side of the auxiliary pumping unit side channel 46 with a push-out pressure chamber feed opening 52 which is provided within the transverse housing surface 28. A fluid flow through the push-out pressure chamber feed channel 50 into the push-out pressure chamber 40 and thus the hydraulic pressure of the push-out pressure chamber 40 can be controlled via a control valve 54 which is arranged close to the push-out pressure chamber feed opening 52 within the first housing element 14.

The controllable mechanical motor vehicle coolant pump 10 comprises a push-in pressure chamber 56 which is defined axially by the second housing element 48 as well as by the slider bottom wall 26 of the control slider 22, is defined radially outwards by the slider side wall 24 of the control slider 22, and is defined radially inwards by the inner slider support surface 32 as well as by the second housing element 48. The push-in pressure chamber 56 is in direct fluidic communication with the discharge flow cross section D of the coolant pump wheel 16, and is thus always hydraulically pressurized by the pressurized coolant discharged from the coolant pump wheel 16 during pump operation independent of the present shifting position of the control slider 22. The push-in pressure chamber 56 thus always generates a hydraulic push-in push force during pump operation, which push-in push force pushes the slider bottom wall 26 away from the second housing element 48 and towards the transverse housing surface 28.

A present axial shifting position of the control slider 22, and thereby the effective discharge flow cross section D-eff of the coolant pump wheel 16, and thus the coolant discharge flow of the controllable mechanical motor vehicle coolant pump 10, can be controlled by controlling the hydraulic pressure of the push-out pressure chamber 40 via the control valve 54. If the hydraulic pressure of the push-out pressure chamber 40 is higher than the hydraulic pressure of the push-in pressure chamber 56, the control slider 22 is pushed further out, i.e., away from the transverse housing surface 28, thereby decreasing the effective discharge flow cross section D-eff. If the hydraulic pressure of the push-out pressure chamber 40 is lower than the hydraulic pressure of the push-in pressure chamber 56, the control slider 22 is pushed further in, i.e., towards the transverse housing surface 28, thereby increasing the effective discharge flow cross section D eff.

The present invention is not limited to embodiments described herein; reference should be had to the appended claims.

LIST OF REFERENCE NUMERALS

10 controllable mechanical motor vehicle coolant pump
12 drive shaft
14 first housing element
16 coolant pump wheel
18 suction chamber
20 discharge chamber
22 control slider
24 slider side wall
26 slider bottom wall
28 transverse housing surface
30 radially inner bottom wall surface
32 inner slider support surface
34 radially outer side wall surface
36 outer slider support surface
38 cylindrical protrusion
40 push-out pressure chamber
42 auxiliary pumping unit
44 auxiliary pumping unit pump wheel
46 auxiliary pumping unit side channel
48 second housing element
50 push-out pressure chamber feed channel
52 push-out pressure chamber feed opening
54 control valve
56 push-in pressure chamber
D discharge flow cross section
D-eff effective discharge flow cross section

What is claimed is:

1. A controllable mechanical motor vehicle coolant pump comprising:

a drive shaft which extends in an axial pump direction and which is configured to rotate and to be mechanically driven by an engine of a motor vehicle;

a coolant pump wheel which is co-rotatably connected with the drive shaft and which is configured to pump a liquid coolant;

a transverse housing surface which extends substantially transversely with respect to the drive shaft and which radially surrounds the drive shaft;

a cylindrical inner slider support surface which radially surrounds the drive shaft and which is coaxial to the drive shaft, the transverse housing surface and the cylindrical inner slider support surface each being defined by a first housing element;

a control slider which is substantially pot-shaped and which is configured to be axially shiftable with respect to the coolant pump wheel so as to control an effective discharge flow cross-section of the coolant pump wheel, the control slider comprising, a substantially cylindrical slider side wall which is configured to radially surround the coolant pump wheel, and a slider bottom wall which extends substantially transversely with respect to the drive shaft and which is arranged axially between the coolant pump wheel and the transverse housing surface, the slider bottom wall comprising a radially inner bottom wall surface which is shiftably supported by the cylindrical inner slider support surface;

a push-out pressure chamber which, is arranged between the slider bottom wall and the transverse housing surface, is defined at one axial side by the transverse housing surface and radially inwardly by the cylindrical inner slider support surface, and is configured to be hydraulically pressurized so as to generate a hydraulic push-out push force which pushes the slider bottom wall toward the coolant pump wheel; and an auxiliary pumping unit which is configured to hydraulically pressurize the push-out pressure chamber, the auxiliary pumping unit comprising, an auxiliary pumping unit side channel which is defined by a separate second housing element which is arranged between the coolant pump wheel and the transverse housing surface, and an auxiliary pumping unit pump wheel which is provided on a back side of the coolant pump wheel facing the separate second housing element.

2. The controllable mechanical motor vehicle coolant pump as recited in claim 1, further comprising:

a cylindrical outer slider support surface, wherein, the substantially cylindrical slider side wall comprises a radially outer side wall surface, the cylindrical outer slider support surface shiftably supports the radially outer side wall surface of the substantially cylindrical slider side wall, and the first housing element further defines the cylindrical outer slider support surface.

3. The controllable mechanical motor vehicle coolant pump as recited in claim 1, further comprising:

a push-out pressure chamber feed channel which is configured to fluidically connect the push out pressure chamber with a discharge side of the auxiliary pumping unit side channel, wherein, a section of the push-out pressure chamber feed channel extends between the drive shaft and the cylindrical inner slider support surface.

4. The controllable mechanical motor vehicle coolant pump as recited in claim 1, further comprising:

a push-in pressure chamber which is located axially between the coolant pump wheel and the slider bottom wall, the push-in pressure chamber being configured to be hydraulically pressurized so as to generate a hydraulic push-in push force which pushes the slider bottom wall away from the coolant pump wheel.

5. A controllable mechanical motor vehicle coolant pump comprising:

a drive shaft which extends in an axial pump direction and which is configured to rotate and to be mechanically driven by an engine of a motor vehicle;

a coolant pump wheel which is co-rotatably connected with the drive shaft and which is configured to pump a liquid coolant;

a transverse housing surface which extends substantially transversely with respect to the drive shaft and which radially surrounds the drive shaft;

a cylindrical inner slider support surface which radially surrounds the drive shaft and which is coaxial to the drive shaft;

a first housing element which defines both the transverse housing surface and the cylindrical inner slider support surface;

a separate second housing element which is arranged between the coolant pump wheel and the transverse housing surface;

a control slider which is substantially pot-shaped and which is configured to be axially shiftable with respect to the coolant pump wheel so as to control an effective discharge flow cross-section of the coolant pump wheel, the control slider comprising, a substantially cylindrical slider side wall which is configured to radially surround the coolant pump wheel, and a slider bottom wall which extends substantially transversely with respect to the drive shaft and which is arranged axially between the coolant pump wheel and the transverse housing surface, the slider bottom wall comprising a radially inner bottom wall surface which is shiftably supported by the cylindrical inner slider support surface;

a push-out pressure chamber which, is arranged between the slider bottom wall and the transverse housing surface, is defined at one axial side by the transverse housing surface and radially inwardly by the cylindrical inner slider support surface, and is configured to be hydraulically pressurized so as to generate a hydraulic push-out push force which pushes the slider bottom wall toward the coolant pump wheel; and a push-in pressure chamber which is located axially between the coolant pump wheel and the slider bottom wall, the push-in pressure chamber being configured to be hydraulically pressurized so as to generate a hydraulic push-in push force which pushes the slider bottom wall away from the coolant pump wheel, wherein, no contact interface exists between the first housing element and the separate second housing element at a radially inner side of the push-out pressure chamber, and a contact interface is arranged between the first housing element and the separate second housing element at the push-in pressure chamber.

6. The controllable mechanical motor vehicle coolant pump as recited in claim 5, further comprising:

a cylindrical outer slider support surface, wherein, the substantially cylindrical slider side wall comprises a radially outer side wall surface, the cylindrical outer slider support surface shiftably supports the radially outer side wall surface of the substantially cylindrical slider side wall, and the first housing element further defines the cylindrical outer slider support surface.

7. The controllable mechanical motor vehicle coolant pump as recited in claim 5, further comprising:

an auxiliary pumping unit which is configured to hydraulically pressurize the push-out pressure chamber, the auxiliary pumping unit comprising, an auxiliary pumping unit side channel which is defined by the separate second housing element, and an auxiliary pumping unit pump wheel which is provided on a back side of the coolant pump wheel facing the separate second housing element.

8. The controllable mechanical motor vehicle coolant pump as recited in claim 7, further comprising:

a push-out pressure chamber feed channel which is configured to fluidically connect the push out pressure chamber with a discharge side of the auxiliary pumping unit side channel, wherein, a section of the push-out pressure chamber feed channel extends between the drive shaft and the cylindrical inner slider support surface.

9. The controllable mechanical motor vehicle coolant pump as recited in claim 7, further comprising:

a push-in pressure chamber which is located axially between the coolant pump wheel and the slider bottom wall, the push-in pressure chamber being configured to be hydraulically pressurized so as to generate a hydraulic push-in push force which pushes the slider bottom wall away from the coolant pump wheel.

10. A controllable mechanical motor vehicle coolant pump comprising:

a drive shaft which extends in an axial pump direction and which is configured to rotate and to be mechanically driven by an engine of a motor vehicle;

a coolant pump wheel which is co-rotatably connected with the drive shaft and which is configured to pump a liquid coolant;

a transverse housing surface which extends substantially transversely with respect to the drive shaft and which radially surrounds the drive shaft;

a cylindrical inner slider support surface which radially surrounds the drive shaft and which is coaxial to the drive shaft;

a control slider which is substantially pot-shaped and which is configured to be axially shiftable with respect to the coolant pump wheel so as to control an effective discharge flow cross-section of the coolant pump wheel, the control slider comprising, a substantially cylindrical slider side wall which is configured to radially surround the coolant pump wheel, and a slider bottom wall which extends substantially transversely with respect to the drive shaft and which is arranged axially between the coolant pump wheel and the transverse housing surface, the slider bottom wall comprising a radially inner bottom wall surface which is shiftably supported by the cylindrical inner slider support surface;

a push-out pressure chamber which, is arranged between the slider bottom wall and the transverse housing surface, is defined at one axial side by the transverse housing surface and radially inwardly by the cylindrical inner slider support surface, and is configured to be hydraulically pressurized so as to generate a hydraulic push-out push force which pushes the slider bottom wall toward the coolant pump wheel; and a cylindrical outer slider support surface, wherein, the transverse housing surface and the cylindrical inner slider support surface are both defined by a first housing element, the substantially cylindrical slider side wall comprises a radially outer side wall surface, the cylindrical outer slider support surface shiftably supports the radially outer side wall surface of the substantially cylindrical slider side wall, and the first housing element further defines the cylindrical outer slider support surface.

11. The controllable mechanical motor vehicle coolant pump as recited in claim 10, further comprising:

an auxiliary pumping unit which is configured to hydraulically pressurize the push-out pressure chamber, the auxiliary pumping unit comprising, an auxiliary pumping unit side channel which is defined by a separate second housing element which is arranged between the coolant pump wheel and the transverse housing surface, and an auxiliary pumping unit pump wheel which is provided on a back side of the coolant pump wheel facing the separate second housing element.

12. The controllable mechanical motor vehicle coolant pump as recited in claim 11, further comprising:

a push-out pressure chamber feed channel which is configured to fluidically connect the push out pressure chamber with a discharge side of the auxiliary pumping unit side channel, wherein, a section of the push-out pressure chamber feed channel extends between the drive shaft and the cylindrical inner slider support surface.

13. The controllable mechanical motor vehicle coolant pump as recited in claim 11, further comprising:

a push-in pressure chamber which is located axially between the coolant pump wheel and the slider bottom wall, the push-in pressure chamber being configured to be hydraulically pressurized so as to generate a hydraulic push-in push force which pushes the slider bottom wall away from the coolant pump wheel.

14. The controllable mechanical motor vehicle coolant pump as recited in claim 10, wherein the control slider is provided as one piece.

* * * * *